US007485084B2

(12) United States Patent
Borgström et al.

(10) Patent No.: US 7,485,084 B2
(45) Date of Patent: Feb. 3, 2009

(54) APPARATUS AND METHOD FOR CONTROLLING THE RADIAL LEVEL OF AN INTERFACE IN A CENTRIFUGAL SEPARATOR

(75) Inventors: Leonard Borgström, Tyresö (SE); Lasse Hurnasti, Huddinge (SE)

(73) Assignee: Alfa Laval Corporate AB, Lund (SE)

( * ) Notice: Subject to any disclaimer, the term of this patent is extended or adjusted under 35 U.S.C. 154(b) by 0 days.

(21) Appl. No.: 11/817,814

(22) PCT Filed: Mar. 2, 2006

(86) PCT No.: PCT/SE2006/000274

§ 371 (c)(1),
(2), (4) Date: Feb. 6, 2008

(87) PCT Pub. No.: WO2006/096113

PCT Pub. Date: Sep. 14, 2006

(65) Prior Publication Data

US 2008/0171645 A1 Jul. 17, 2008

(30) Foreign Application Priority Data

Mar. 8, 2005 (SE) ..... 0500534

(51) Int. Cl.
*B04B 11/00* (2006.01)
*B04B 13/00* (2006.01)

(52) U.S. Cl. ..... 494/2; 494/10; 494/30; 494/37; 494/56

(58) Field of Classification Search ..... 494/1–6, 494/10, 11, 23, 25–30, 56, 68–70, 37
See application file for complete search history.

(56) References Cited

U.S. PATENT DOCUMENTS 3,408,000 A * 10/1968 Carl-Goran ..... 494/10
3,580,493 A * 5/1971 Jonsson ..... 494/2
3,642,196 A * 2/1972 Nilsson ..... 494/2
3,750,940 A 8/1973 Nilsson
3,752,389 A 8/1973 Nilsson
4,525,155 A 6/1985 Nilsson
4,755,165 A 7/1988 Gunnewig (Continued)

FOREIGN PATENT DOCUMENTS

JP 07246349 A * 9/1995

(Continued)

*Primary Examiner*—Charles E Cooley
(74) *Attorney, Agent, or Firm*—Michaud-Duffy Group LLP

(57) ABSTRACT

The invention refers to a centrifugal separator and a method of separating a product to a heavy phase and light phase. A centrifuge rotor encloses a closed separation space, which has a radially outer part for the heavy phase, a radially inner part for the light phase and a central gas-filled space. The radially outer part is separated from the radially inner part by a interface layer level. An inlet extends into the separation space for feeding the product. A first outlet extend from the radially outer part for discharge of the heavy phase. A second outlet extends from the radially inner part for discharge of the light phase. A control equipment permits control of the interface layer level to a desired radial position. A sensor senses a parameter related to the gas pressure in the central space. The control equipment controls the counter pressure in the first outlet in response to the sensed parameter for controlling the interface layer level to the desired radial position.

25 Claims, 5 Drawing Sheets

U.S. PATENT DOCUMENTS

| | | | | |
|---|---|---|---|---|
| 6,080,098 | A * | 6/2000 | Borgstrom et al. | 494/27 |
| 6,616,589 | B1 | 9/2003 | Machans | |
| 6,837,842 | B1 * | 1/2005 | Dellden | 494/2 |
| 6,976,948 | B1 | 12/2005 | Hamblad | |
| 2008/0171645 | A1 * | 7/2008 | Borgstrom et al. | |

FOREIGN PATENT DOCUMENTS

| | | | |
|---|---|---|---|
| JP | 07284693 | A * | 10/1995 |
| JP | 2002119891 | A * | 4/2002 |
| JP | 2002166198 | A * | 6/2002 |
| SE | B-345603 | | 7/1970 |
| SE | 514774 | | 4/2001 |
| SE | 521432 | | 11/2003 |
| WO | WO 86/01436 | | 3/1986 |
| WO | WO 96/34693 | | 11/1996 |

* cited by examiner

APPARATUS AND METHOD FOR CONTROLLING THE RADIAL LEVEL OF AN INTERFACE IN A CENTRIFUGAL SEPARATOR

FIELD OF THE INVENTION

The present invention refers to a centrifugal separator for separating a product in at least a relatively heavy phase and a relationship light phase. The invention also refers to a method for separating said product.

BACKGROUND OF THE INVENTION

SE-B-514 774 discloses a centrifugal separator of the kind initially defined. As appears from this document, it could be difficult to maintain the interface layer level at the desired radial position during operation of the centrifugal separator. This can be due to the fact that a non-controllable quantity of separated heavy phase, including separated solid particles, are discharged per time unit. If the discharged quantity of heavy phase, for instance would exceed a quantity of fed heavy phase, the interface layer level will be radially displaced outwardly. This problem is solved in SE-B-514 774 by means of a control equipment comprising separate members for supply and discharge of a control fluid which has a higher density than the light phase.

A common separation case is that the heavy phase is controlled in the manner mentioned above in such a way that the counter pressure in the outlet of the heavy phase is maintained at a determined level and that the light phase flows over an overflow outlet. In such a separation case, it may occur that the interface layer level is displaced to an undesired radial position due to the gas pressure prevailing at the free liquid surface adjacent to the overflow outlet. Such a displacement of the interface layer level may lead to a poor separation and/or breaking of the water seal.

In a centrifugal separator, including a paring disc with venting holes and atmospheric pressure outside the bowl, this problem will not arise. The actual gas pressure is then the atmospheric pressure, which can be regarded as constant. This problem does not occur also when there is the conventional configuration with a flow over an overflow outlet for the heavy phase and over an overflow outlet for the light phase, wherein the radial levels of both the overflow outlets control the radial position of the interface layer level. If this configuration comprises a paring disc with venting holes for the light phase, the same gas pressure prevails at the free liquid surface adjacent to the overflow outlets both for the heavy phase and the light phase, which means that the interface layer level will not be influenced by variations in the gas pressure.

However, if one of the phases is controlled with respect to the counter pressure, a variation in the gas pressure will influence directly the radial position of the interface layer level if corresponding compensation of the counter pressure is not made on the phase controlled with respect to the counter pressure. Variations in the gas pressure adjacent to the overflow outlet arise when the gas adjacent to the overflow outlet lacks a free flow path for pressure equalization. The variations of the gas pressure become large especially when the product to be separated and to be supplied to the centrifugal separator has a high steam pressure, i.e. an oil-water mixture, which is saturated with natural gas and which has a temperature close to the boiling point of the water phase.

SUMMARY OF THE INVENTION

The object of the present invention is to improve upon or solve the above-mentioned problem.

The present invention resides in one aspect in a centrifugal separator designed in such a way that the separation space is closed to an environment and permits maintaining of a gas pressure in the central gas-filled space of the separation space, which gas pressure deviates from the pressure of the environment. The centrifugal separator comprises a sensor, which is provided to sense, during operation, a parameter that is related to the gas pressure in the central gas-filled space of the separation space and which is connected to the control equipment. The control equipment is arranged to control the counter pressure in at least one of the first outlet and the second outlet in response to the sensed parameter for controlling the interface layer level to the desired radial position.

By means of such control equipment it is possible to maintain, during substantially the whole operation, the interface layer level at a desired radial position which is optimal for separation results. In particular, it is possible to maintain the interface layer level at the desired position even if the product to be separated has a varying quality. For instance with respect to the quantity of liquid/gas, and a varying temperature which is closed to the boiling point of the liquid. If the pressure in the central gas space of the separation space increases the counter pressure in one of the outlets may increase rapidly, by means of the equipment according to the invention. This rapid increase can occur in such a way that the radial position of the interface layer level is maintained.

According to an embodiment of the invention, the control equipment is arranged to control the counter pressure in at least one of the first outlet and the second outlet during a flow through said outlet from the centrifuge rotor. According to this embodiment, the invention may be realized in an easy manner by controlling the counter pressure in one of the outlets through an influence of the flow of the heavy phase or the light phase.

According to a further embodiment of the invention, the control equipment is arranged to also control the counter pressure in at least one of the first outlet and the second outlet by, when needed, permitting the provision of flow into the centrifuge rotor through one of the first outlet and the second outlet. According to this embodiment, the control equipment is thus adapted to permit, when needed, that the flow in one of the outlets flows backwards, i.e. back into the centrifugal rotor. Such an embodiment is especially advantageous in the case that a solid product is discharged via radial nozzles and the percentage of heavy phase in the product to be separated is low, wherein an unallowably high quantity of the heavy phase would leave the centrifuge rotor via these nozzles in such a way that the interface layer level moves too far radially outwardly or disappears completely. Such a process can be prevented by the proposed feeding back of heavy phase or feeding of a control fluid having a density which is substantially the same as the density of the heavy phase.

According to a further embodiment of the invention, the control equipment comprises at least one valve for controlling the counter pressure in one of the first outlet and the second outlet. Such a valve enables an easy realization of the control of the counter pressure.

According to a further embodiment of the invention, the valve is provided on the first outlet. Advantageously, the control equipment may then be arranged to permit a flow of the heavy phase through the first outlet both into and out from the centrifuge rotor for controlling the counter pressure. The control equipment may then comprise a valve which permits a flow into the centrifuge rotor via the first outlet, and a valve, which permits a flow out from the centrifuge rotor via the first outlet.

According to a further embodiment of the invention, said valve is provided on the second outlet. The control equipment may then be arranged to permit a flow of the light phase through the second outlet, especially out from the centrifuge rotor for controlling the counter pressure, but it is also possible within the scope of the present invention to arrange the control equipment to permit a flow of the light phase through the second outlet also into the centrifuge rotor for controlling the counter pressure. The control equipment then comprises a valve, which permits a flow out from the centrifuge rotor via the second outlet, but may also comprise a valve, which permits a flow into the centrifuge rotor via the second outlet.

According to a further embodiment of the invention, the control equipment comprises means for providing a control fluid and is arranged to permit supply of said control fluid to one of the radially outer part and the radially inner part. The control fluid can be formed by a separate fluid, which is fed into the radially outer part and the radially inner part, respectively, or by one of the heavy phase and the light phase which is fed back into the radially outer part and the radially inner part, respectively.

According to a further embodiment of the invention, the control equipment is arranged to permit said supply of control fluid via the first outlet, i.e. supply of heavy phase.

According to a further embodiment of the invention, an overflow outlet is provided between the radially inner part and the second outlet. The invention may then advantageously be realized by a counter pressure control of the heavy phase.

According to a further embodiment of the invention, an overflow outlet is provided between the radially outer part and the first outlet. The invention may then advantageously be realized by a counter pressure control of the light phase.

According to a further embodiment of the invention, the sensor comprises a pressure sensor, which may sense the gas pressure directly in the central gas-filled space or a pressure depending on this gas pressure.

The object is also achieved by the method initially defined, which is characterized by the following steps of: maintaining a gas pressure in the central gas-filled space of the separation space, which gas pressure deviates from the pressure of the environment, sensing a parameter, which is related to the gas pressure in the central gas-filled space of the separation space, and controlling the gas pressure in at least one of the first outlet and the second outlet in response to the sensed parameter for controlling the interface layer level to the desired radial position Advantageous further developments of the method are defined in the dependent claims.

BRIEF DESCRIPTION OF THE DRAWINGS

The present invention is now to be explained more closely by means of embodiments described by way of example and with reference to the drawings attached hereto.

DETAILED DESCRIPTION OF VARIOUS EMBODIMENTS OF THE INVENTION

Figure 1:
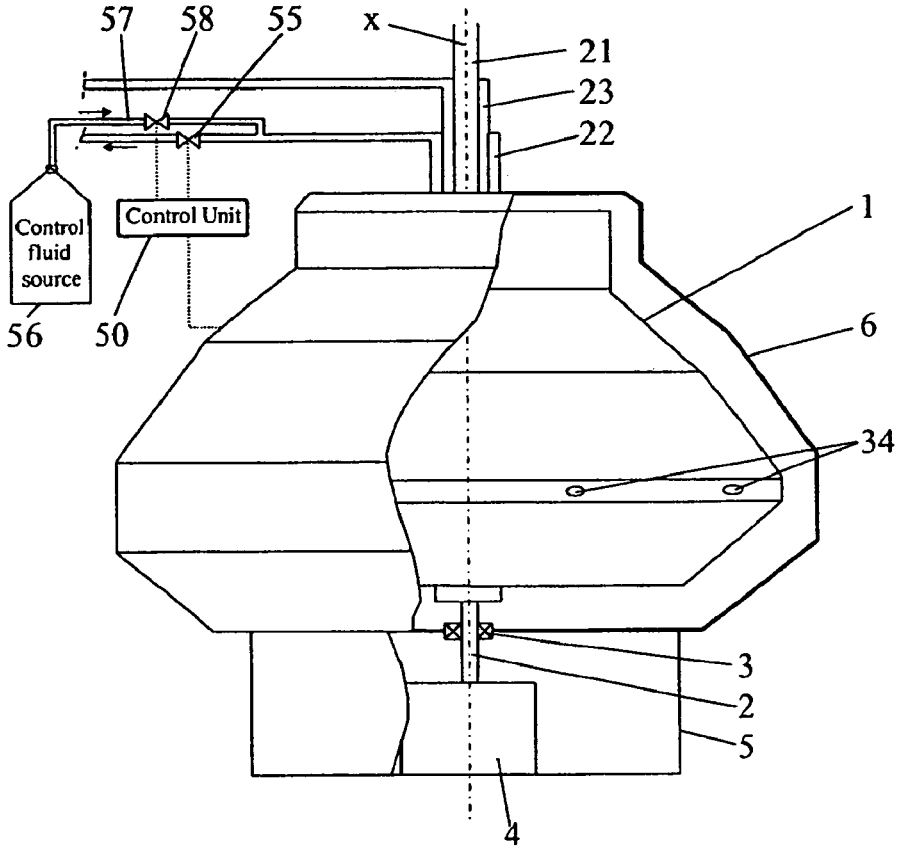
FIG. 1 discloses schematically a partly sectional view of a centrifugal separator.

FIG. 1 discloses a centrifugal separator according to the invention. The centrifugal separator disclosed is designed for separation of a product in a relatively heavy phase and relatively light phase. Furthermore, the centrifugal separator may be designed for separation of sludge or a solid phase in form of heavy particles.

The centrifugal separator comprises a centrifuge rotor 1, which is mounted to a spindle 2. The spindle 2 is journelled in a bearing 3 and driven by means of a suitable drive member 4, which is provided in a frame 5. The rotor 1 is provided in a casing 6 and is by means of the drive member 4 rotatable around an axis x of rotation. The rotor 1 comprises a rotor wall 7, which encloses a separation space 8, see FIGS. 2-5. The separation space 8 has a radially outer part 11 in which the separated heavy phase is collected during operation, and a radially inner part 12, in which the separated light phase is collected during operation. Furthermore, the separation space 8 has a central gas-filled space 13 against which the collected separated light phase forms a free liquid surface. The radially outer part 11, i.e. the part for the separated heavy phase, is separated from the radially inner part 12, i.e. the part for the separated light phase, by an interface layer level 14 formed during operation.

The centrifuge rotor 1 also comprises in a manner known per se a set of conical separation discs 15, which are disclosed schematically in FIGS. 2-5. The separation discs 15 are provided between an upper delimiting disc 16 and a lower delimiting disc 17 which comprises an inlet 18 for the product to be separated.

Moreover, centrifugal separator comprises an inlet 21, a first outlet 22 and a second outlet 23. The inlet 21 comprises a stationary inlet conduit 24 which extends into the separation space 8 through the rotor wall 7. The inlet 21 is arranged to permit during operation feeding of the product to the separation space 8.

The first outlet 22 extends from the radially outer part 11 through the rotor wall 7 and is arranged to permit during operation discharge of the heavy phase through the first outlet 22. The first outlet 22 comprises a stationary first outlet conduit 25 and a stationary paring disc 26, which is connected to the first outlet conduit 25 and which is provided in a first paring chamber 27 for the heavy phase. The first paring chamber 27 communicates with the radially outer part 11 via one or several heavy phase channels 28.

The second outlet 23 extends from the radially inner part 12 through the rotor wall 7 and is arranged to permit during operation discharge of the light phase through the second outlet 23. The second outlet 23 comprises a stationary second outlet conduit 30 and a stationary paring disc 31, which is connected to the second outlet conduit 30 and which is provided in a second paring chamber 32 for the light phase. The second paring chamber 32 communicates with the radially inner part 12 via an overflow outlet 38 provided therebetween.

The centrifuge rotor 1 may possibly but not necessarily also comprise schematically disclosed nozzles 34, which are intended for continuous discharge of sludge or solid particles from the radially outer part 11 of the separation space 8.

The centrifuge rotor 1 may as an alternative comprise a device which is intended to discharge intermittently in a manner known per se sludge or solid particles from the radially outer part 11 of the separation space 8.

The centrifugal separator is designed in such a way that the separation space 8 is closed to an environment and permits maintaining of a gas pressure in the central gas-filled space 13 of the separation space 8, which gas pressure deviates from the pressure of the environment. This closing of the separation space 8 may be provided in different ways, which is illustrated in the various embodiments in FIGS. 2-5.

Figure 2:
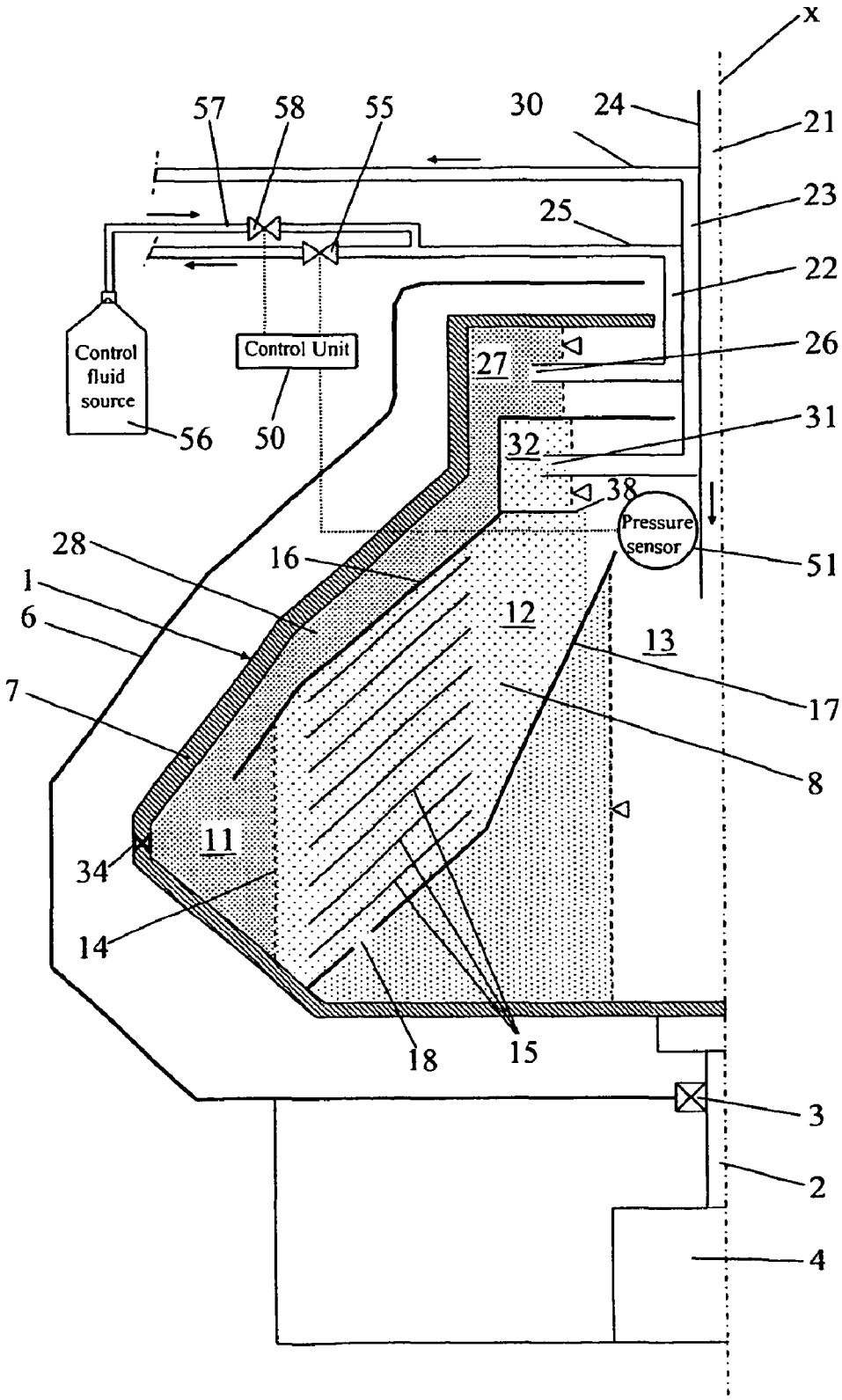
FIG. 2 discloses schematically a sectional view of a part of a centrifugal separator according to a second embodiment of the invention.
Figure 4:
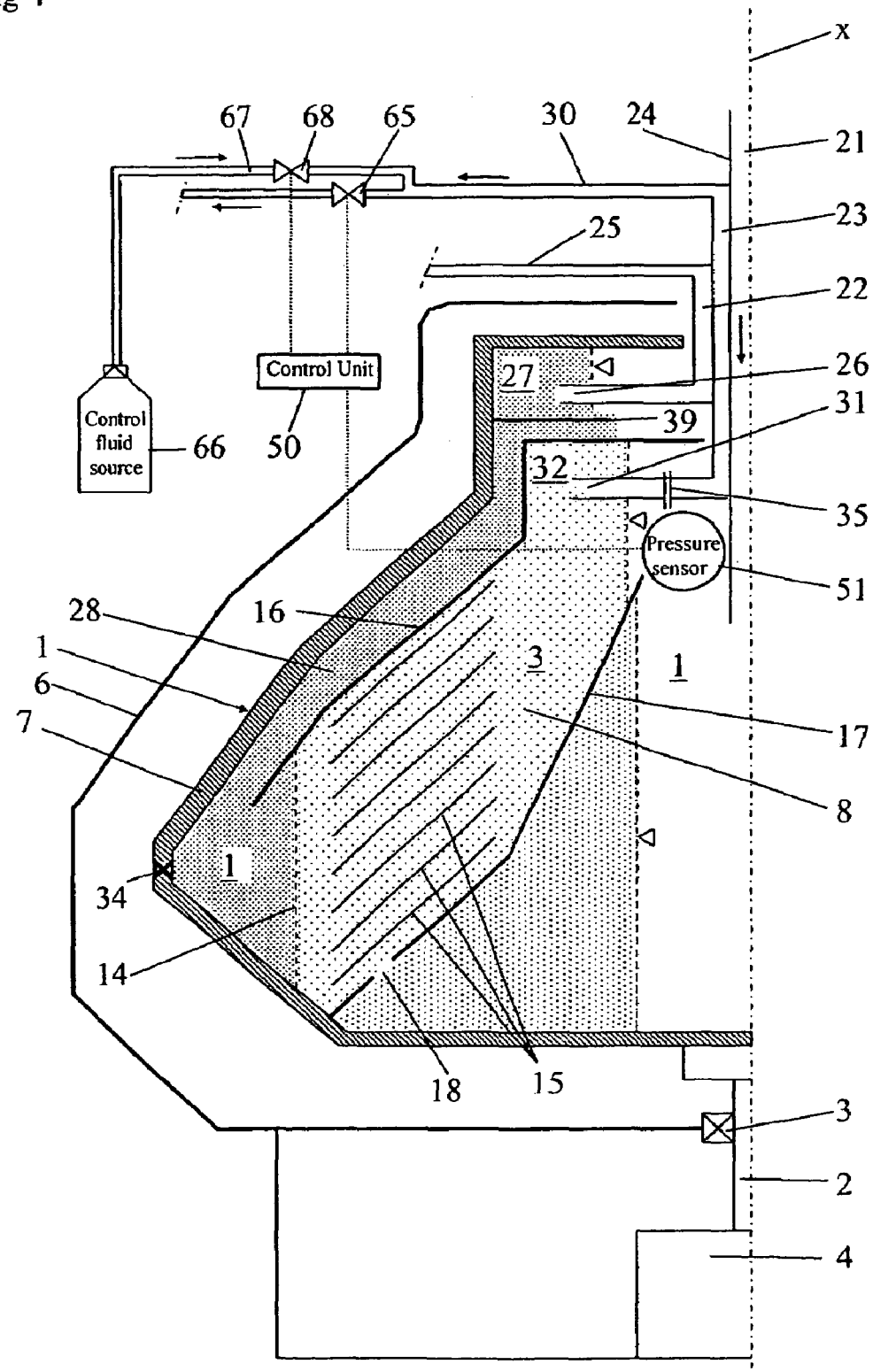
FIG. 4 discloses schematically a sectional view of a part of a centrifugal separator according to a fourth embodiment of the invention.

In the first embodiment, which is disclosed in FIG. 2, and the third embodiment, which is disclosed in FIG. 4, the casing 6 is open to the environment, wherein the separation space 8 is closed by means of the first paring chamber 27 and the first paring disc 26, which forms a liquid seal preventing the gas pressure in the gas-filled space 13 of the separation space 8 from propagating out to the environment. In the first and third embodiments, the second paring disc 31 may possibly but not necessarily be provided with a venting hole 35 which permits that the pressure propagates through the second paring chamber 32. Such a venting hole 35 is illustrated in FIG. 4.

In the third embodiment, which is disclosed in FIG. 4, an overflow outlet 39 is provided between the radially outer part 11 and the first outlet 22, or more specifically between the radially outer part 11 and the first paring chamber 27.

Figure 3:
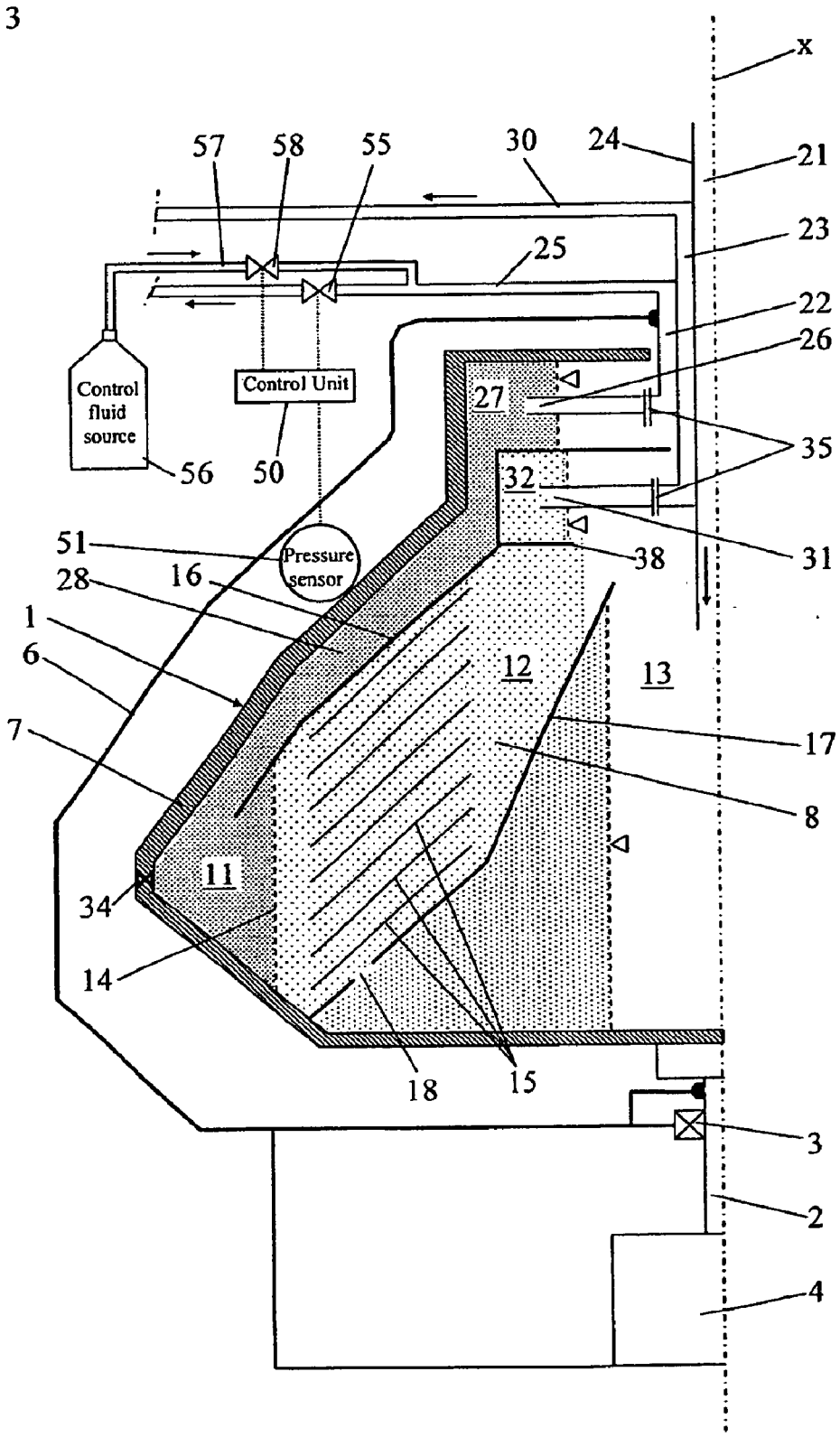
FIG. 3 discloses schematically a sectional view of a part of a centrifugal separator according to a third embodiment of the invention.
Figure 5:
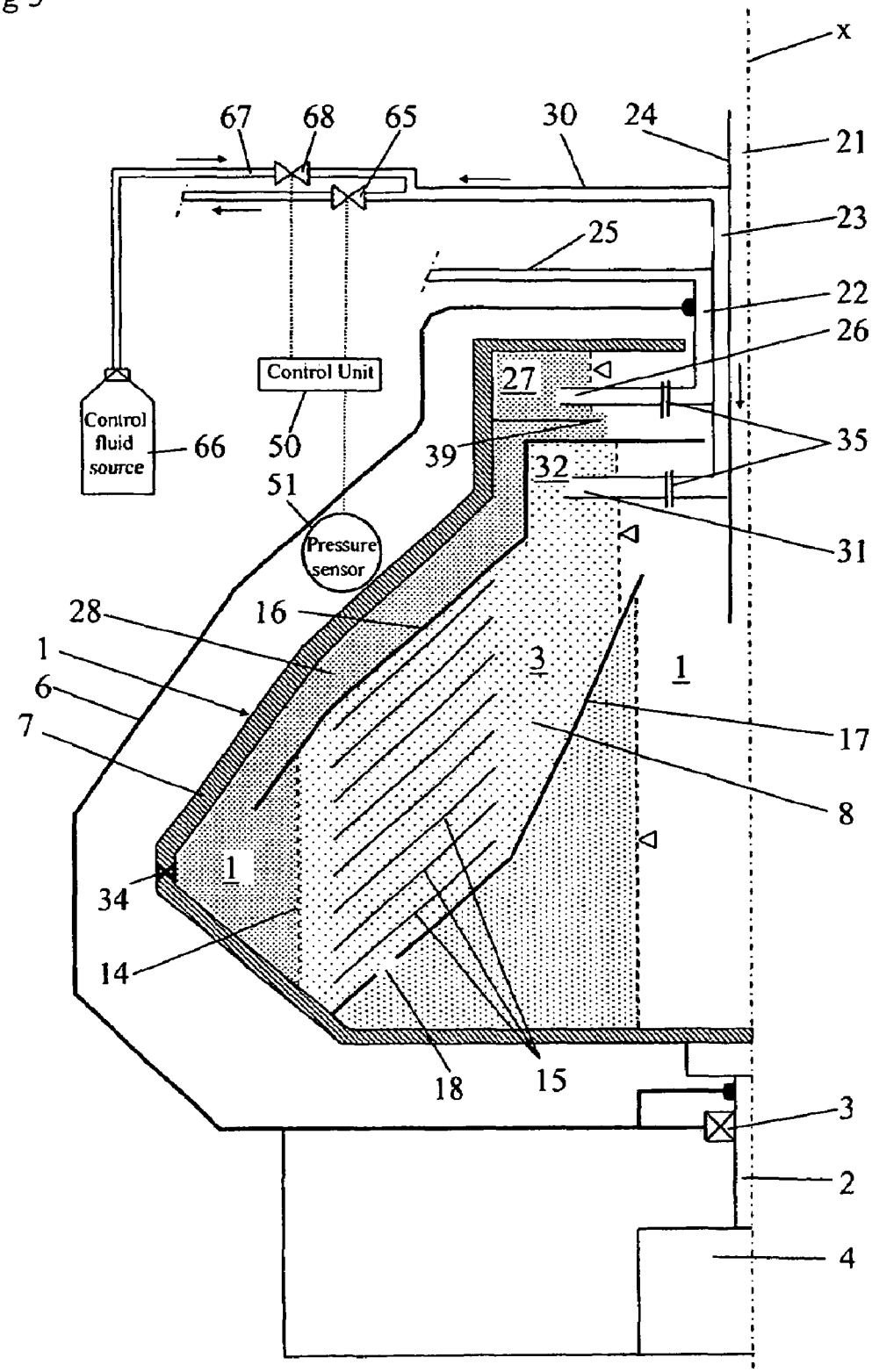
FIG. 5 discloses schematically a sectional view of a part of a centrifugal separator according to a fifth embodiment of the invention.

In the second embodiment, which is disclosed in FIG. 3, and the fourth embodiment, which is disclosed in FIG. 5, the separation space 8 is closed by means of the casing 6, which completely encloses the centrifuge rotor 1 relatively the environment and forms a pressure vessel. In the second embodiment and the fourth embodiment, both the second paring disc 31 and the first paring disc 26 may possibly but not necessarily be provided with a venting hole 35, which permits that the pressure propagates through the two paring chambers 27 and 32.

In the second embodiment, which is disclosed in FIG. 3, an overflow outlet 38 is provided between the radially inner part 12 and the second outlet 23, or more specifically between the radially inner part 12 and the second paring chamber 32.

In the fourth embodiment, which is disclosed in FIG. 5, an overflow outlet 39 is provided between the radially outer part 11 and the first outlet 22, or more specifically between the radially outer part 11 and the first paring chamber 27.

The centrifugal separator also comprises control equipment arranged to permit during operation control of the interface layer level 14 to a desired radial position by controlling the counter pressure in at least one of the first outlet 22 and the second outlet 23. The control equipment comprises a control unit 50. A sensor is connected to the control unit 50 and provided to sense during operation a parameter related to the gas pressure in the gas-filled space of the separation space 8. In the embodiments disclosed, the sensor is a pressure sensor 51, which senses a gas pressure which is substantially equal to the gas pressure in the central gas-filled space 13 of the separation space 8. In the first and third embodiments, the pressure sensor 51 is provided in the central gas-filled space 13 and in the second and fourth embodiments, the pressure sensor 51 is provided outside the rotor 1 but inside the closed casing 6.

Instead of sensing directly the gas pressure in the central gas-filled space 13 of the separation space 8, the sensor may sense another pressure related to this gas pressure, or any other parameter related to this pressure.

The control equipment is arranged to control the counter pressure in at least one of the first outlet 22 and the second outlet 23 depending on the pressure sensed by the pressure sensor 51 for controlling the interface layer level 14 to the desired radial position.

In the first embodiment, which is disclosed in FIG. 2, the control equipment is arranged to control the counter pressure in the first outlet 22. Thanks to the overflow outlet 38, between the radially inner part 12 and the second outlet 23, the radial position of the interface layer level 14 may be determined by the counter pressure in the first outlet 22. This counter pressure can be controlled in various ways. According to one variant, the counter pressure may be controlled by an influence or a throttling of a flow of the heavy phase discharged through the first outlet 22. Such a throttling may be provided in an easy manner by means of a valve 55. The valve 55 is suitably connected to the control unit 50, which controls the valve 55 in response to the gas pressure sensed by the pressure sensor 51. If the gas pressure in the central gas space 13 of the separation space 8 increases, the counter pressure in the first outlet 22 may rapidly be increased so that the desired radial position of the interface layer level 14 is maintained. According to another variant, the control equipment may be arranged to control also the counter pressure in the first outlet 22 by when needed permit providing of a flow into the centrifuge rotor 1 through the first outlet 22. Such a flow of heavy phase back into the radially outer part 11 may be provided by means of a control fluid, which is supplied from any suitable source 56 via a conduit 57 which is connected to the first outlet conduit 25. The source 56 provides the control fluid at a sufficient pressure and the counter pressure may in this case be controlled by means of a valve 58 on the conduit 57. Also the valve 58 is connected to the control unit 50, which controls the valve 58 in response to the gas pressure sensed by the pressure sensor 51.

If for instance a too large quantity of sludge, solid particles and and/or heavy phase has been discharged via the nozzles 34 the interface layer level and thus also the free liquid surface in the first paring chamber 27 will be displaced radially outwardly, wherein the liquid covering of the first paring disc 26 decreases, which leads to a reduction of the pressure in the first outlet 22. This can be counteracted by throttling the flow by means of the valve 55 or by supplying heavy phase via the conduit 57. The control fluid may be formed by the discharged heavy phase which is fed back into the radially outer part 11 or by a separate fluid, which is fed into the radially outer part 11 via the conduit 57 and the first outlet conduit 25 and which has a density corresponding to the density of the heavy phase.

The second embodiment, which is disclosed in FIG. 3, differs from the first embodiment in that the separation space is closed by means of the casing 6 as has been described above. It is to be noted that in the second embodiment both the paring discs 26 and 31 may be provided with venting holes 35, which enable the pressure sensor 51 in the second embodiment to be provided outside the rotor 1 but inside the casing 6 instead of inside the rotor 1. To the rest, the control equipment is substantially identical to the control equipment of the first embodiment. Since the counter pressure control also in the second embodiment takes place on the heavy phase, an overflow outlet 38 is advantageously provided between the radially inner part 12 and the second outlet 23.

The third embodiment, which is disclosed in FIG. 4, differs from the first embodiment in that the control equipment is arranged to control the counter pressure in the second outlet 23. Thanks to the overflow outlet 39 between the radially outer part 11 and the first outlet 22, the radial position of the interface layer level 14 may be determined by the counter pressure in the second outlet 23. This counter pressure may be controlled in substantially the same way as in the first embodiment. According to a variant, the counter pressure may be controlled by a influence or a throttling of a flow of the light phase discharged through the second outlet 23. Such a throttling may be provided in an easy manner by means of a valve 65. The valve 65 is suitably connected to the control unit 50, which controls the valve 65 in response to the gas pressure sensed by the pressure sensor 51. If the gas pressure in the central gas space 13 of the separation space 8 increases, the counter pressure in the second outlet 23 may rapidly be increased so that the desired radial position of the interface layer level 14 is maintained. As mentioned above, it is also possible within the scope of the invention that the control equipment is arranged also to control the counter pressure in the second outlet 23 by when needed permitting providing of a flow into the centrifuge rotor 1 through the second outlet 23. Such a flow of light phase back into the radially outer part 11 may be provided by means of a control fluid supplied from any suitable source 66 via a conduit 67 which is connected to the second outlet conduit 30. The source 66 supplies the control fluid at a sufficient pressure and the counter pressure may in this case be controlled by means of a valve 68 on the conduit 67. Also the valve 68 is connected to the control unit 50, which controls the valve 68 in response to the gas pressure sensed by the pressure sensor 51.

If the interface layer level 14 is displaced for instance radially inwardly, the free liquid surface in the radially inner part 12 is displaced radially outwardly, wherein the liquid covering of the second paring disc 38 decreases, which leads to a reduction of the pressure in the second outlet 23. This may be counteracted by throttling the flow through the valve 65, but it is also possible in this embodiment to counteract this by supplying the light phase to the radially inner part 12 via the conduit 67 and the second outlet conduit 30. The control fluid may be formed by the discharged light phase which is fed back into the radially inner part 12 or by a separate fluid, which is fed into the radially inner part 12 via the conduit 67 and the second outlet 30 and which has a density corresponding to the density of the light phase.

The fourth embodiment, which is disclosed in FIG. 5, differs from the third embodiment in that the separation space 8 is closed by means of the casing 6 as has been described above. It is to be noted that in the fourth embodiment, both the paring discs 26 and 31 may be provided with venting holes 35, which enable the pressure sensor 51 in the fourth embodiment to be provided outside the rotor 1 but inside the casing 6 instead of inside the rotor 1. To the rest, the control equipment is substantially identical to the control equipment of the third embodiment. Since the counter pressure control also in the fourth embodiment takes place on the light phase, an overflow outlet 39 is advantageously provided between the radially outer part 11 and the first outlet 22.

The invention is not limited to the embodiments disclosed but may be varied and modified within the scope of the following claims. According to a further embodiment, the counter pressure in both the outlets 22 and 23 may be controlled in the manner described above. In these embodiments no overflow outlet 38, 39 is needed.

What is claimed is:

1. A centrifugal separator for separation of a product in a least a relatively heavy phase and a relatively light phase, wherein the centrifugal separator comprises:

a centrifuge rotor, which is rotatable around an axis (x) of rotation and comprises a rotor wall that encloses a separation space, which has a radially outer part, in which the heavy phase separated during operation is collected, and a radially inner part, in which the light phase separated during operation is collected, wherein the separation space has a central gas-filled space against which the collected separated light phase forms a free liquid surface and wherein the radially outer part is separated from the radially inner part by an interface layer level formed during operation, an inlet, which extends into the separation space through the rotor wall and is arranged to permit during operation feeding of the product to the separation space, a first outlet, which extends from the radially outer part through the rotor wall and is arranged to permit during operation discharge of the heavy phase through the first outlet, a second outlet, which extends from the radially inner part through the rotor wall and is arranged to permit during operation discharge of the light phase through the second outlet, and control equipment, arranged to permit during operation control of the interface layer level to a desired radial position by controlling the counter pressure in a least one of the first outlet and the second outlet, the centrifugal separator being designed in such a way that the separation space is closed to an environment and permits maintaining of a gas pressure in the central gas-filled space of the separation space, which gas pressure deviates from the pressure of the environment, a sensor for sensing, during operation, a parameter that is related to the gas pressure in the central gas-filled space of the separation space and which is connected to the control equipment, and the control equipment being arranged to control the counter pressure in at least one of the first outlet and the second outlet in response to the sensed parameter for controlling the interface layer level to the desired radial position.

2. A centrifugal separator according to claim 1, wherein the control equipment being arranged to control the counter pressure in at least one of the first outlet and the second outlet during a flow through said outlet out from the centrifuge rotor.

3. A centrifugal separator according to claim 1, wherein the control equipment is arranged to control the counter pressure in at least one of the first outlet and the second outlet by, when needed, permitting the provision of a flow into the centrifuge rotor through one of the first outlet and the second outlet.

4. A centrifugal separator according to claim 1, wherein the control equipment comprises at least one valve for controlling the counter pressure in one of the first outlet and the second outlet.

5. A centrifugal separator according to claim 4, wherein said valve is provided on the first outlet.

6. A centrifugal separator according to claim 5, wherein the control equipment is arranged to permit a flow through the first outlet both into and out from the centrifuge rotor for controlling the counter pressure.

7. A centrifugal separator according to claim 6, wherein the control equipment comprises a valve, which permits a flow into the centrifuge rotor via the first outlet, and a valve, which permits a flow out from the centrifuge rotor via the first outlet.

8. A centrifugal separator according to claim 5, wherein an overflow outlet is provided between the radially inner part and the second outlet.

9. A centrifugal separator according to claim 4, wherein said valve is provided on the second outlet.

10. A centrifugal separator according to claim 9, wherein the control equipment is arranged to permit a flow through the second outlet both into and out from the centrifuge rotor for controlling the counter pressure.

11. A centrifugal separator according to claim 10, wherein the control equipment comprises a valve, which permits a flow into the centrifuge rotor via the second outlet, and a valve, which permits a flow out from the centrifuge rotor via the second outlet.

12. A centrifugal separator according to claim 9, wherein an overflow outlet is provided between the radially outer part and first outlet.

13. A centrifugal separator according to claim 1, wherein the control equipment comprises means for providing a control fluid and is arranged to permit supply of said control fluid to one of the radially outer part and the radially inner part.

14. A centrifugal separator according to claim 13, wherein the control fluid is formed by a separate fluid, which is fed into the radially outer part and the radially inner part, respectively.

15. A centrifugal separator according to claim 13, wherein the control fluid is formed by one of the heavy phase and light phase, which is fed back into the radially outer part and the radially inner part, respectively.

16. A centrifugal separator according to claim 13, wherein the control equipment is arranged to permit said supply of control fluid via the first outlet.

17. A centrifugal separator according to claim 1, wherein the sensor comprises a pressure sensor.

18. A method for separating a product in at least a relatively heavy phase and relatively light phase in a centrifugal separator comprising a centrifuge rotor, which is rotatable around an axis of rotation and comprises a rotor wall enclosing a separation space, wherein the method comprises the steps of:

feeding the product to the separation space through an inlet, which extends into the separation space through the rotor wall, rotation of the centrifuge rotor in such a way that the separated heavy phase is collected in a radially outer part of the separation space and the separated light phase is collected in a radially inner part of the separation space, wherein the separation space has a central gas-filled space against which the collected separated light phase forms a free liquid surface and wherein the radially outer part is separated from the radially inner part by a interface layer level formed during operation, discharging the heavy phase from the radially outer part in a first flow through a first outlet, discharging the light phase from the radially inner part in a second flow through a second outlet, controlling the interface layer level to a desired radial position by controlling the counter pressure in at least one of the first outlet and the second outlet, maintaining a gas pressure in the central gas-filled space of the separation space, which gas pressure deviates from the pressure of the environment, sensing a parameter, which is related to the gas pressure in the central gas-filled space of the separation space, and controlling the gas pressure in at least one of the first outlet and the second outlet in response to the sensed parameter for controlling the interface layer level to the desired radial position.

19. A method according to claim 18, wherein the counter pressure is controlled in at least one of the first outlet and the second outlet during a flow through said outlet out from the centrifuge rotor.

20. A method according to claim 18, wherein the counter pressure is controlled in at least one of the first outlet and the second outlet by when needed providing a flow into the centrifuge rotor through one of the first outlet and the second outlet.

21. A method according to claim 18, wherein the counter pressure is controlled by a flow through the first outlet both into and out from the centrifuge rotor.

22. A method according to claim 18, wherein the counter pressure is controlled by a flow through the second outlet both into and out from the centrifuge rotor.

23. A method according to claim 18, wherein the counter pressure is controlled by means of a control fluid which is supplied to one of the radially outer part and the radially inner part.

24. A method according to claim 23, wherein the control fluid is formed by a separate fluid which is fed into the radially outer part and the radially inner part.

25. A method according to claim 23, wherein the control fluid is formed by one of the heavy phase and the light phase which is fed back to the radially outer part and the radially inner part.

* * * * *